US011024955B2

(12) United States Patent
Onaka et al.

(10) Patent No.: US 11,024,955 B2
(45) Date of Patent: Jun. 1, 2021

(54) ANTENNA MODULE AND COMMUNICATION APPARATUS

(71) Applicant: Murata Manufacturing Co., Ltd., Kyoto (JP)

(72) Inventors: Kengo Onaka, Kyoto (JP); Yoshiki Yamada, Kyoto (JP); Hirotsugu Mori, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 16/749,219

(22) Filed: Jan. 22, 2020

(65) Prior Publication Data

US 2020/0161749 A1 May 21, 2020

Related U.S. Application Data

(63) Continuation of application No. PCT/JP2018/026614, filed on Jul. 13, 2018.

(30) Foreign Application Priority Data

Jul. 31, 2017 (JP) ..... JP2017-147314

(51) Int. Cl.
*H01Q 1/38* (2006.01)
*H01Q 1/48* (2006.01)
*H01Q 21/06* (2006.01)

(52) U.S. Cl.
CPC ..... *H01Q 1/38* (2013.01); *H01Q 1/48* (2013.01); *H01Q 21/065* (2013.01)

(58) Field of Classification Search
CPC ..... H01Q 1/38; H01Q 1/48; H01Q 21/065; H01Q 21/24; H01Q 1/2283; H01P 3/08
(Continued)

(56) References Cited

U.S. PATENT DOCUMENTS 9,385,435 B2 * 7/2016 Bily ..... H01Q 13/28
10,320,089 B2 * 6/2019 Jakoby ..... H01Q 3/34
(Continued)

FOREIGN PATENT DOCUMENTS

JP H01-103302 A 4/1989
JP H04-122106 A 4/1992
(Continued)

OTHER PUBLICATIONS

International Search Report for International Application No. PCT/JP2018/026614, dated Sep. 11, 2018.
(Continued)

*Primary Examiner* — Eugene Yun
(74) *Attorney, Agent, or Firm* — Pearne & Gordon LLP

(57) ABSTRACT

An antenna module includes a dielectric substrate, a radiation electrode formed on the front face of the dielectric substrate, an RFIC and a ground electrode formed on the rear face of the dielectric substrate, a ground line arranged in the dielectric substrate, and a power supply line including a power supply line portion arranged in parallel to a main surface of the dielectric substrate. The ground electrode is arranged between the power supply line portion and the RFIC. The ground line is arranged between the power supply line portion and the radiation electrode. The ground electrode includes the radiation electrode and part of the power supply line portion in a plan view. The ground line includes part of the power supply line portion in the plan view. The area in which the ground line is formed is smaller than the area in which ground electrode is formed.

20 Claims, 14 Drawing Sheets

(58) Field of Classification Search
USPC ..... 455/73
See application file for complete search history.

(56) References Cited

U.S. PATENT DOCUMENTS

| | | | | |
|---|---|---|---|---|
| 2014/0306846 | A1 | 10/2014 | Nakatsu | |
| 2017/0005409 | A1* | 1/2017 | Yamagajo | H01Q 21/24 |
| 2017/0133763 | A1* | 5/2017 | Suzuki | H01Q 9/0407 |
| 2017/0222316 | A1 | 8/2017 | Mizunuma | |
| 2017/0229769 | A1 | 8/2017 | Yokoyama et al. | |

FOREIGN PATENT DOCUMENTS

| | | | |
|---|---|---|---|
| JP | H05-090829 | A | 4/1993 |
| JP | H06-291544 | A | 10/1994 |
| JP | H07307612 | A | 11/1995 |
| JP | H10-303612 | A | 11/1998 |
| JP | 2004-328539 | A | 11/2004 |
| JP | 2006-270759 | A | 10/2006 |
| JP | 2014-212361 | A | 11/2014 |
| WO | 2016/063759 | A1 | 4/2016 |
| WO | 2016067969 | A1 | 5/2016 |

OTHER PUBLICATIONS

Written Opinion for International Application No. PCT/JP2018/026614, dated Sep. 11, 2018.
Office Action for Japanese Patent Application No. 2019-534014 dated Dec. 1, 2020.
Notice of Reasons for Rejection for Japanese Patent Application No. 2019-534014 dated Feb. 2, 2021.

* cited by examiner

FIRST EXAMPLE (ANTENNA MODULE 1A)

FIRST COMPARATIVE EXAMPLE (ANTENNA MODULE 500A)

REFLECTION CHARACTERISTICS

BANDPASS CHARACTERISTICS

ANTENNA MODULE AND COMMUNICATION APPARATUS

This is a continuation of International Application No. PCT/JP2018/026614 filed on Jul. 13, 2018 which claims priority from Japanese Patent Application No. 2017-147314 filed on Jul. 31, 2017. The contents of these applications are incorporated herein by reference in their entireties.

BACKGROUND

Technical Field

The present invention relates to an antenna module and a communication apparatus.

Antenna modules for wireless communication are disclosed, which include an antenna conductor layer arranged on the front face of a dielectric substrate, a ground layer and a transmission line arranged in inner layers of the dielectric substrate, and a radio-frequency semiconductor device arranged on the rear face of the dielectric substrate (for example, refer to Patent Document 1).

Patent Document 1: International Publication No. 2016/067969

BRIEF SUMMARY

However, in the antenna module disclosed in Patent Document 1, the ground layer (ground electrode) is positioned between a dipole antenna (radiation electrode) and a line component of the transmission line (power supply line), which is parallel to a mounting face. Accordingly, the distance between the dipole antenna (radiation electrode) and the ground layer (ground electrode) is shorter than the thickness of the dielectric substrate. In other words, there is a problem in that the antenna volume defined by the above distance is made relatively small and, thus, it is not possible to ensure antenna characteristics, such as a frequency bandwidth and a gain that are required.

The present invention provides an antenna module and a communication apparatus having improved antenna characteristics through an increase in the antenna volume.

An antenna module according to an aspect of the present invention includes a dielectric substrate having a first main surface and a second main surface, which are opposed to each other with their back surfaces; a radiation electrode formed at the first main surface side of the dielectric substrate; a radio-frequency circuit element formed at the second main surface side of the dielectric substrate; a ground electrode formed at the second main surface side of the dielectric substrate; a ground line arranged in the dielectric substrate along a direction parallel to the first main surface and the second main surface; and a power supply line that electrically connects the radiation electrode to the radio-frequency circuit element. The power supply line includes a first power supply line portion arranged in the dielectric substrate along the direction parallel to the first main surface and the second main surface and a second power supply line portion arranged in the dielectric substrate along a direction vertical to the first main surface and the second main surface. The ground electrode is arranged between the first power supply line portion and the radio-frequency circuit element in a cross-sectional view of the dielectric substrate. The ground line is arranged between the first power supply line portion and the radiation electrode in the cross-sectional view. The ground electrode includes the radiation electrode and part of the first power supply line portion in a plan view of the dielectric substrate. The ground line includes part of the first power supply line portion in the plan view. The area in which the ground line is formed is smaller than the area in which the ground electrode is formed in the plan view.

With the above configuration, the radiation electrode and the ground electrode are capable of being arranged with no restriction of the arrangement of the first power supply line portion. In addition, the ground line arranged between the radiation electrode and the first power supply line portion is smaller than the ground electrode in the above plan view. Accordingly, the antenna volume defined by the effective volume of the dielectric body between the radiation electrode and the ground electrode is capable of being ensured without necessarily increasing the thickness of the dielectric substrate itself. Consequently, the antenna characteristics, such as the frequency bandwidth and the gain, which are determined by the antenna volume, are improved, compared with the antenna module having the configuration in which the ground electrode is arranged between the radiation electrode and the first power supply line portion.

The ground line may be formed along a direction in which the first power supply line portion extends and may be overlapped with part of the radiation electrode in the plan view.

With the above configuration, a so-called strip line structure in which the first power supply line portion is sandwiched between the ground line and the ground electrode is capable of being ensured close to a feeding point of the radiation electrode. Accordingly, the impedance of the power supply line is capable of being set with high accuracy to reduce radio-frequency propagation loss.

The radiation electrode may have a rectangular shape in the plan view and may have a feeding point for transmitting a radio-frequency signal between the radiation electrode and the power supply line. In the plan view, the first power supply line portion may intersect with an end side closest to the feeding point, among multiple end sides composing an outer perimeter of the radiation electrode.

With the above configuration, in the plan view, the ratio of the area of the power supply line and the ground line to the area in which the radiation electrode is formed is capable of being minimized. Accordingly, it is possible to maximize the antenna volume to further improve the antenna characteristics.

The radiation electrode may include multiple radiation electrodes discretely arranged on the dielectric substrate along the direction parallel to the first main surface and the second main surface. The ground electrode may include the multiple radiation electrodes and part of the first power supply line portion in the plan view of the dielectric substrate.

With the above configuration, the multiple radiation electrodes and the ground electrode are capable of being arranged with no restriction of the arrangement of the first power supply line portion. In addition, the ground line arranged between the multiple radiation electrodes and the first power supply line portion is smaller than the ground electrode in the above plan view. Accordingly, it is possible to realize an array antenna in which the antenna volume defined by the effective volume of the dielectric body between the multiple radiation electrodes and the ground electrode is ensured. Consequently, the antenna characteristics, such as the frequency bandwidth and the gain, which are determined by the antenna volume, are improved, compared with the antenna module having the configuration in which the ground electrode is arranged between the multiple radiation electrodes and the first power supply line portion.

An antenna module according to an aspect of the present invention includes a substrate having a first flat plate portion and a second flat plate portion the normal directions of which intersect with each other and which are connected with each other; a first dielectric substrate that has a first main surface and a second main surface, which are opposed to each other with their back surfaces, the second main surface being in contact with a front face of the first flat plate portion; a second dielectric substrate that has a third main surface and a fourth main surface, which are opposed to each other with their back surfaces, the fourth main surface being in contact with a front face of the second flat plate portion; a first radiation electrode formed at the first main surface side of the first dielectric substrate; a second radiation electrode formed at the third main surface side of the second dielectric substrate; a radio-frequency circuit element formed at a rear face side of the first flat plate portion; a first ground electrode formed on the first flat plate portion; a second ground electrode formed on the second flat plate portion; a first ground line arranged in the first dielectric substrate along a direction parallel to the first main surface and the second main surface; a first power supply line that electrically connects the first radiation electrode to the radio-frequency circuit element; and a second power supply line that electrically connects the second radiation electrode to the radio-frequency circuit element. At least one of the first power supply line and the second power supply line includes a first power supply line portion arranged in the first dielectric substrate along the direction parallel to the first main surface and the second main surface and a second power supply line portion arranged in the first dielectric substrate along a direction vertical to the first main surface and the second main surface. The first ground electrode is arranged between the first power supply line portion and the radio-frequency circuit element in a cross-sectional view of the first dielectric substrate. The first ground line is arranged between the first power supply line portion and the first radiation electrode in the cross-sectional view. The first ground electrode includes the first radiation electrode and part of the first power supply line portion in a plan view of the first dielectric substrate. The first ground line includes part of the first power supply line portion in the plan view. The area in which the first ground line is formed is smaller than the area in which the first ground electrode is formed in the plan view.

With the above configuration, the antenna module includes a first patch antenna composed of the first radiation electrode, the first dielectric substrate, the first power supply line, and the first ground electrode and a second patch antenna composed of the second radiation electrode, the second dielectric substrate, the second power supply line, and the second ground electrode. The first patch antenna and the second patch antenna have different directivities. Accordingly, the antenna characteristics are improved. In addition, in the first patch antenna, the first radiation electrode and the first ground electrode are capable of being arranged with no restriction of the arrangement of the first power supply line portion. Furthermore, the first ground line arranged between the first radiation electrode and the first power supply line portion is smaller than the first ground electrode in the plan view of the first dielectric substrate. Accordingly, the antenna volume defined by the effective volume of the dielectric body between the first radiation electrode and the first ground electrode is capable of being ensured without necessarily increasing the thickness of the first dielectric substrate itself. Consequently, the antenna characteristics, such as the frequency bandwidth and the gain, which are determined by the antenna volume, are improved, compared with the antenna module having the configuration in which the first ground electrode is arranged between the first radiation electrode and the first power supply line portion.

The first ground line may be formed along a direction in which the first power supply line portion extends and may be overlapped with part of the first radiation electrode in the plan view of the first dielectric substrate.

With the above configuration, a so-called strip line structure in which the first power supply line portion is sandwiched between the first ground line and the first ground electrode is capable of being ensured close to the feeding point of the first radiation electrode. Accordingly, the impedance of the power supply line is capable of being set with high accuracy to reduce the radio-frequency propagation loss.

The antenna module may further include a third power supply line that electrically connects the first radiation electrode to the radio-frequency circuit element. A first patch antenna composed of the first radiation electrode, the first dielectric substrate, the first power supply line, the third power supply line, and the first ground electrode may form first polarization and second polarization different from the first polarization. The first polarization and the second polarization may have directivity in a direction perpendicular to the first flat plate portion.

With the above configuration, it is possible to compose a so-called dual polarization antenna module in the radiation direction of the first patch antenna composed of the first radiation electrode, the first dielectric substrate, the first power supply line, and the first ground electrode.

The antenna module may further include a second ground line arranged in the second dielectric substrate along a direction parallel to the third main surface and the fourth main surface. The second power supply line may include the first power supply line portion arranged in the first dielectric substrate along the direction parallel to the first main surface and the second main surface, the second power supply line portion arranged in the first dielectric substrate along the direction vertical to the first main surface and the second main surface, a third power supply line portion arranged in the second dielectric substrate along the direction parallel to the third main surface and the fourth main surface, and a fourth power supply line portion arranged in the second dielectric substrate along a direction vertical to the third main surface and the fourth main surface. The second ground electrode may be arranged between the second power supply line portion and a rear face of the second flat plate portion in a cross-sectional view of the second dielectric substrate. The second ground line may be arranged between the third power supply line portion and the second radiation electrode in the cross-sectional view. The second ground electrode may include the second radiation electrode and part of the third power supply line portion in a plan view of the second dielectric substrate. The second ground line may include part of the third power supply line portion in the plan view. The area in which the second ground line is formed may be smaller than the area in which the second ground electrode is formed in the plan view. The first power supply line portion may be continuously connected with the third power supply line portion in a boundary area between the first dielectric substrate and the second dielectric substrate. (1) The first ground electrode and the second ground electrode may be integrally arranged on the substrate across the first flat plate portion and the second flat plate portion and the first ground line and the second ground line may not be formed in a boundary area between the first flat plate portion and the second flat plate portion or (2) the first ground electrode and the second ground electrode may not be formed in the boundary area and the first ground line may be integrally connected with the second ground line in the boundary area between the first dielectric substrate and the second dielectric substrate.

With the above configuration, also in the second patch antenna, the second radiation electrode and the second ground electrode are capable of being arranged with no restriction of the arrangement of the third power supply line portion. In addition, the second ground line arranged between the second radiation electrode and the third power supply line portion is smaller than the second ground electrode in the plan view of the second dielectric substrate. Accordingly, the antenna volume defined by the effective volume of the dielectric body between the second radiation electrode and the second ground electrode is capable of being ensured without necessarily increasing the thickness of the second dielectric substrate itself. Consequently, the antenna characteristics, such as the frequency bandwidth and the gain, which are determined by the antenna volume, are improved, compared with the antenna module having the configuration in which the second ground electrode is arranged between the second radiation electrode and the third power supply line portion. In addition, the second power supply line forms the microstrip line composed of the first ground electrode and the second ground electrode or the microstrip line composed of the first ground line and the second ground line in a boundary area between the first patch antenna and the second patch antenna. Accordingly, since unnecessary resonance does not occur in the side face direction of the first dielectric substrate and the second dielectric substrate in the above boundary area, compared with the strip line in which the second power supply line is sandwiched between the first ground electrode and the second ground electrode and the first ground line and the second ground line, it is possible to reduce the propagation loss of the second power supply line to improve the antenna characteristics of the second patch antenna.

The second ground line may be formed along a direction in which the third power supply line portion extends and may be overlapped with part of the second radiation electrode in the plan view of the second dielectric substrate.

With the above configuration, a so-called strip line structure in which the third power supply line portion is sandwiched between the second ground line and the second ground electrode is capable of being ensured close to the feeding point of the second radiation electrode. Accordingly, the impedance of the second power supply line is capable of being set with high accuracy to reduce the radio-frequency propagation loss.

The antenna module may further include a fourth power supply line that electrically connects the second radiation electrode to the radio-frequency circuit element. A second patch antenna composed of the second radiation electrode, the second dielectric substrate, the second power supply line, the fourth power supply line, and the second ground electrode may form third polarization and fourth polarization different from the third polarization. The third polarization and the fourth polarization may have directivity in a direction perpendicular to the second flat plate portion.

With the above configuration, it is possible to compose a so-called dual polarization antenna module in the radiation direction of the second patch antenna composed of the second radiation electrode, the second dielectric substrate, the second power supply line, and the second ground electrode.

A communication apparatus according to an aspect of the present invention includes any of the antenna modules described above and a baseband integrated circuit (BBIC). The radio-frequency circuit element is an RFIC that performs at least one of transmission-system signal processing in which a signal supplied from the BBIC is subjected to up-conversion and the signal is supplied to the radiation electrode or the first radiation electrode and the second radiation electrode and reception-system signal processing in which a radio-frequency signal supplied from the radiation electrode is subjected to down-conversion and the signal is supplied to the BBIC.

With the above configuration, it is possible to provide the communication apparatus having the improved antenna characteristics through an increase in the antenna volume.

According to the antenna module and the communication apparatus according to the present invention, it is possible to improve the antenna characteristics because of an increase in the antenna volume.

DETAILED DESCRIPTION

Figure 1A:
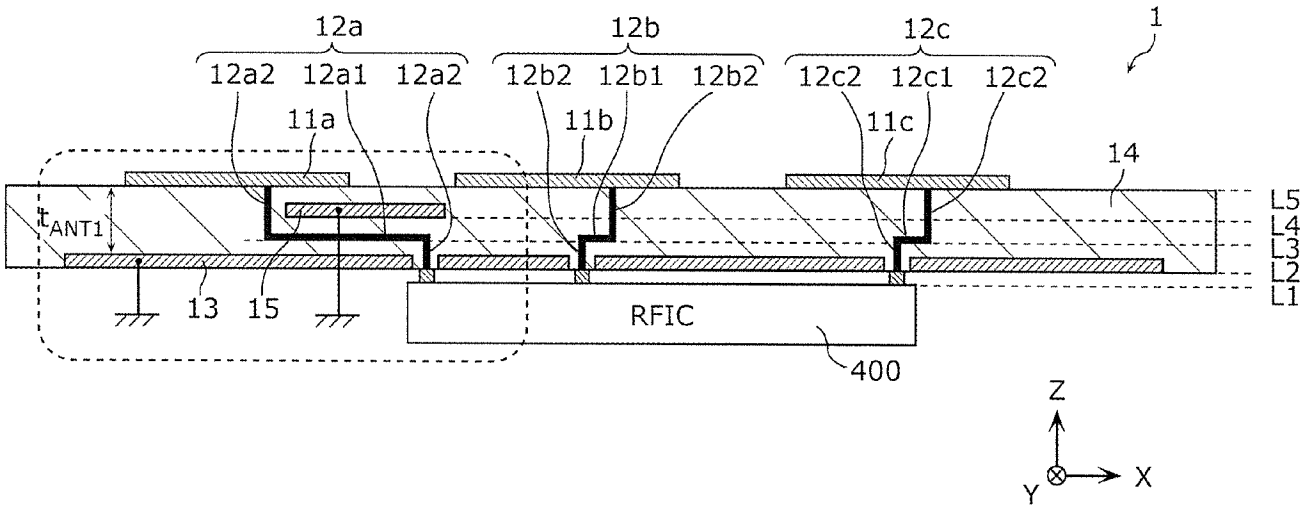
FIG. 1A is a structural cross-sectional view of an antenna module according to a first embodiment.

Embodiments of the present invention will herein be described in detail with reference to the drawings. All the embodiments described below indicate comprehensive or specific examples. Numerical values, shapes, materials, components, the arrangement of the components, the connection mode of the components, and so on, which are indicated in the embodiments described below, are only examples and are not intended to limit the present invention. Among the components in the embodiments described below, the components that are not described in the independent claims are described as optional components. In addition, the sizes or the ratios of the sizes of the components illustrated in the drawings are not necessarily strictly indicated. The same reference numerals are used in the respective drawings to identify substantially the same components and a duplicated description of such components may be omitted or simplified.

First Embodiment

[1.1 Structure of Antenna Module 1 According to Embodiment]

The configuration of an antenna module 1 according to a first embodiment will now be described with reference to FIG. 1A to FIG. 1C.

FIG. 1A is a structural cross-sectional view of the antenna module 1 according to the first embodiment. FIG. 1B is an exploded perspective view of the antenna module 1 according to the first embodiment. FIG. 1C is a perspective plan view of the antenna module 1 according to the first embodiment. As illustrated in FIG. 1A, the antenna module 1 according to the present embodiment includes a dielectric substrate 14, radiation electrodes 11*a*, 11*b*, and 11*c*, a radio-frequency integrated circuit (RFIC) 400, a ground electrode 13, a ground line 15, and power supply lines 12*a*, 12*b*, and 12*c*.

The dielectric substrate 14 has a first main surface and a second main surface, which are opposed to each other with their back surfaces. The radiation electrodes 11*a*, 11*b*, and 11*c* are formed at the first main surface side of the dielectric substrate 14. The RFIC 400 is a radio-frequency signal processing circuit and is a radio-frequency circuit element formed at the second main surface side of the dielectric substrate 14. The ground electrode 13 is formed at the second main surface side of the dielectric substrate 14.

Figure 1B:
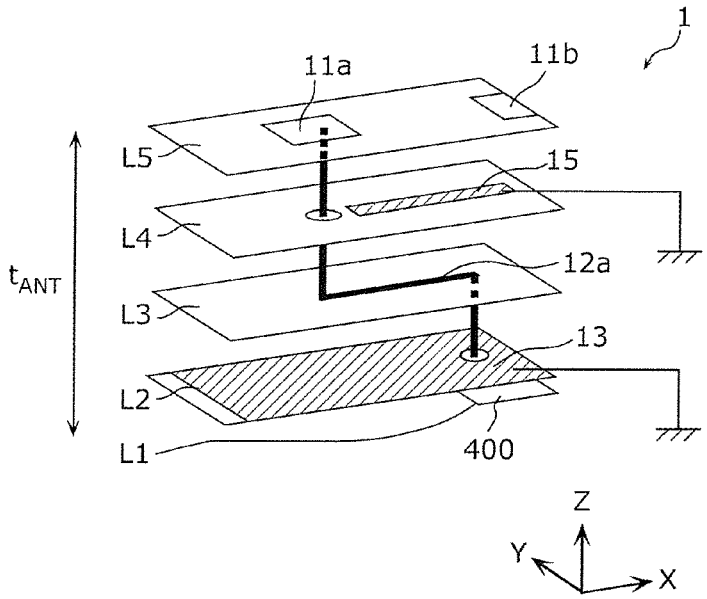
FIG. 1B is an exploded perspective view of the antenna module according to the first embodiment.
Figure 1C:
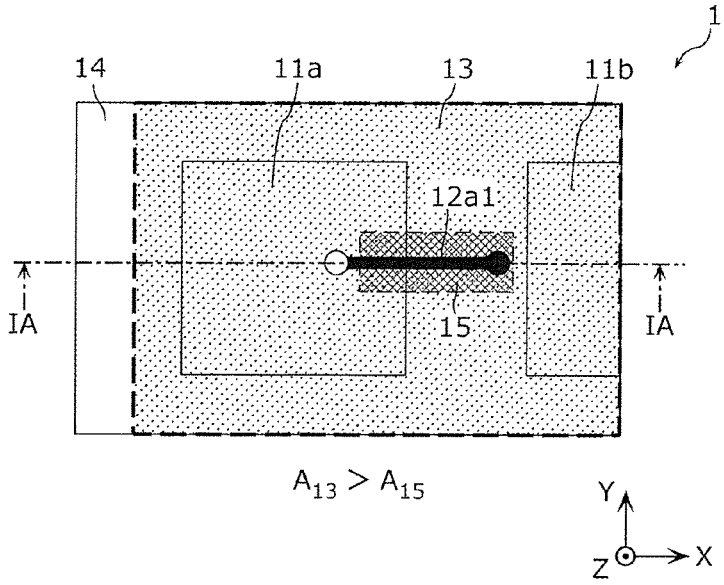
FIG. 1C is a perspective plan view of the antenna module according to the first embodiment.

The ground line 15 is arranged in the dielectric substrate 14 along a direction parallel to the first main surface and the second main surface (along the X-axis direction in FIG. 1A to FIG. 1C). The power supply lines 12*a*, 12*b*, and 12*c* electrically connects the radiation electrodes 11*a*, 11*b*, and 11*c*, respectively, to the RFIC 400. The power supply line 12*a* includes a power supply line portion 12*a*1 (a first power supply line portion) arranged in the dielectric substrate 14 along the X-axis direction and a power supply line portion 12*a*2 (a second power supply line portion) arranged in the dielectric substrate 14 along a direction vertical to the first main surface and the second main surface (along the Z-axis direction in FIG. 1A to FIG. 1C). The power supply line 12*b* includes a power supply line portion 12*b*1 (the first power supply line portion) arranged in the dielectric substrate 14 along the X-axis direction and a power supply line portion 12*b*2 (the second power supply line portion) arranged in the dielectric substrate 14 along the Z-axis direction. The power supply line 12*c* includes a power supply line portion 12*c*1 (the first power supply line portion) arranged in the dielectric substrate 14 along the X-axis direction and a power supply line portion 12*c*2 (the second power supply line portion) arranged in the dielectric substrate 14 along the Z-axis direction.

The RFIC 400 may be a radio-frequency circuit element, such as a radio-frequency filter, an inductor, or a capacitor, instead of the radio-frequency signal processing circuit (RFIC). In addition, the radio-frequency signal processing circuit (RFIC) and the radio-frequency circuit element may be arranged in one package to form the RFIC 400 or the RFIC 400 may be packaged on one chip (in one integrated circuit).

With the above configuration, since the radiation electrodes 11*a*, 11*b*, and 11*c* are opposed to the RFIC 400 in the Z-axis direction with the dielectric substrate 14 sandwiched therebetween, it is possible to shorten the power supply lines 12*a*, 12*b*, and 12*c* with which the RFIC 400 is connected to the radiation electrodes 11*a*, 11*b*, and 11*c*. Accordingly, propagation loss of radio-frequency signals is capable of being reduced.

Next, a characteristic configuration of the antenna module 1 according to the first embodiment will be described.

The ground electrode 13 is arranged between the power supply line portions 12*a*1, 12*b*1, and 12*c*1 and the RFIC 400 in a cross-sectional view of the dielectric substrate 14 (when the dielectric substrate 14 is viewed from the Y-axis direction), as illustrated in FIG. 1A. The ground line 15 is arranged between the power supply line portion 12*a*1 and the radiation electrodes 11*a*, 11*b*, and 11*c* in the above cross-sectional view, as illustrated in FIG. 1A.

The ground electrode 13 includes the radiation electrode 11*a* and part of the power supply line portion 12*a*1 in a plan view of the dielectric substrate 14 (when the dielectric substrate 14 is viewed from the Z-axis direction), as illustrated in FIG. 1C. The ground line 15 includes part of the power supply line portion 12*a*1 in the above plan view.

In the above plan view, a formation area $A_{15}$ of the ground line 15 is smaller than a formation area $A_{13}$ of the ground electrode 13.

In addition, the ground line 15 is formed along a direction in which the power supply line portion 12*a*1 extends and is overlapped with part of the radiation electrode 11*a* in the above plan view.

Although the antenna module 1 according to the present embodiment is described so as to include the multiple radiation electrodes 11*a* to 11*c*, the number of the radiation electrodes is not limited and it is sufficient for the antenna module 1 to include at least one radiation electrode.

[1.2 Structure of Antenna Module 500 According to Comparative Example]

Next, the configuration of an antenna module 500 according to a comparative example will be described.

Figure 2A:
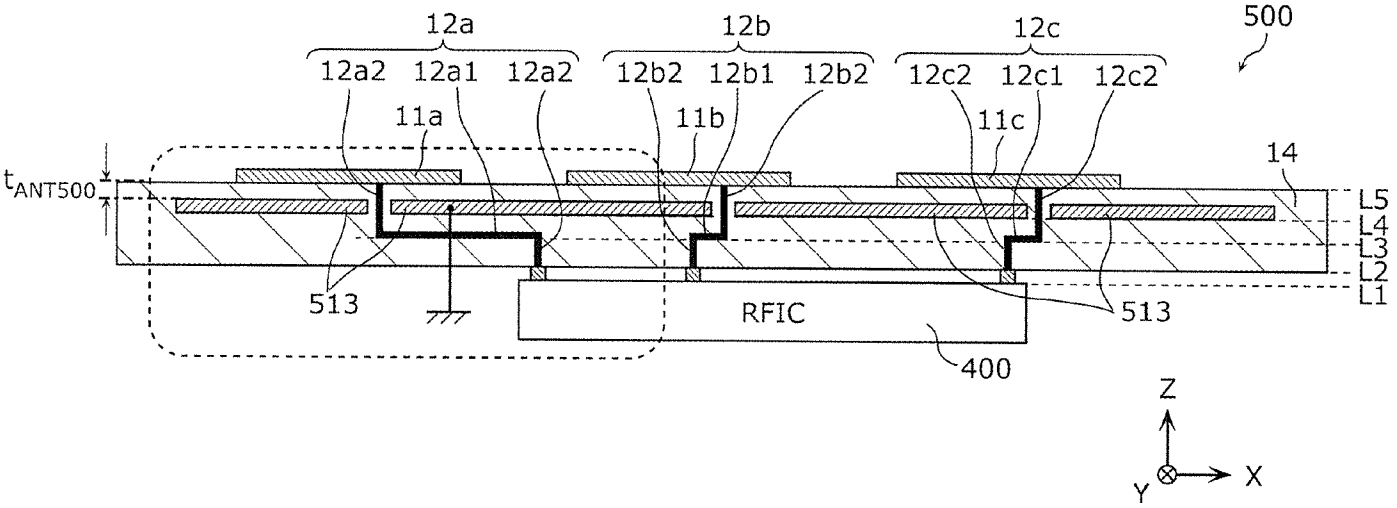
FIG. 2A is a structural cross-sectional view of an antenna module according to a comparative example.
Figure 2B:
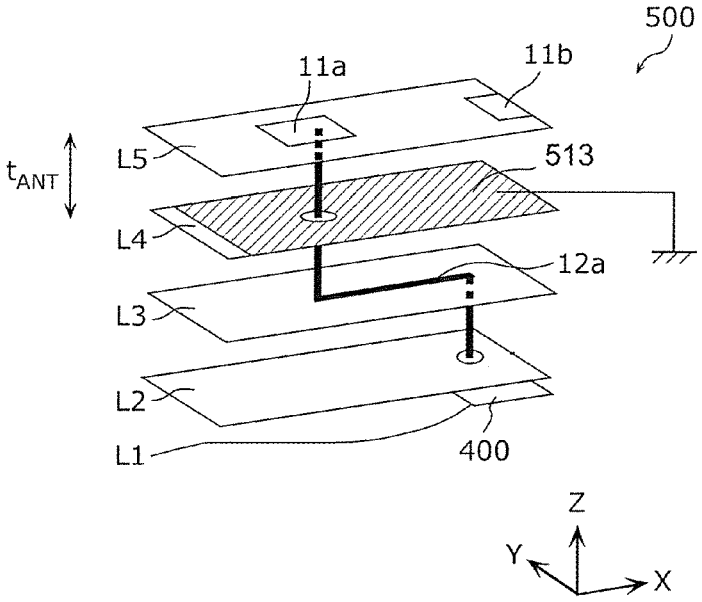
FIG. 2B is an exploded perspective view of the antenna module according to the comparative example.

FIG. 2A is a structural cross-sectional view of the antenna module 500 according to the comparative example. FIG. 2B is an exploded perspective view of the antenna module 500 according to the comparative example.

As illustrated in FIG. 2A, the antenna module 500 according to the comparative example includes the dielectric substrate 14, the radiation electrodes 11*a*, 11*b*, and 11*c*, the RFIC 400, a ground electrode 513, and the power supply lines 12*a*, 12*b*, and 12*c*. The configuration of the antenna module 500 according to the present example differs from that of the antenna module 1 according to the first embodiment in that (1) the ground line is not arranged and in (2) the position where the ground electrode 513 is arranged. As for the antenna module 500 according to the present comparative example, a description of the points common to the antenna module 1 according to the first embodiment is omitted herein and points different from the antenna module 1 according to the first embodiment will be mainly described.

The ground electrode 513 is arranged in the dielectric substrate 14 along the X-axis direction, as illustrated in FIG. 2A, and is arranged between the power supply line portions 12*a*1, 12*b*1, and 12*c*1 and the radiation electrodes 11*a*, 11*b*, and 11*c* in a cross-sectional view of the dielectric substrate 14 (when the dielectric substrate 14 is viewed from the Y-axis direction).

[1.3 Comparison of Characteristics Between Antenna Modules According to First Example and First Comparative Example and Advantages]

In the antenna module 500 according to the comparative example, the ground electrode 513 is arranged between the radiation electrodes 11*a*, 11*b*, and 11*c* and the power supply line portions 12*a*1, 12*b*1, and 12*c*1, as illustrated in FIG. 2A. Accordingly, a thickness $t_{ANT500}$ of the dielectric body between the radiation electrode 11*a* and the ground electrode 513 is smaller than the thickness of the dielectric substrate 14, and the antenna volume defined by the volume of the dielectric body between the radiation electrode and the ground electrode is smaller than the volume of the dielectric substrate 14.

In contrast, in the antenna module 1 according to the first embodiment, the ground electrode 13 is arranged between the power supply line portions 12*a*1, 12*b*1, 12*c*1 and the RFIC 400, as illustrated in FIG. 1A. In the present embodiment, the radiation electrodes 11*a*, 11*b*, and 11*c* and the ground electrode 13 are arranged on the first main surface and the second main surface, respectively, of the dielectric substrate 14. In addition, as illustrated in FIG. 1C, the ground line 15 arranged between the radiation electrode 11*a* and the power supply line portion 12*a*1 is smaller than the ground electrode 13 in the above plan view. More specifically, the ground line 15 is not arranged in the area excluding the area in which the ground line 15 is overlapped with the power supply line portion 12*a*1 in the above plan view. Accordingly, an effective thickness $t_{ANT1}$ of the dielectric body between the radiation electrode 11*a* and the ground electrode 13 is equivalent to the thickness of the dielectric substrate 14. In other words, the antenna volume defined by the volume of the dielectric body between the radiation electrode and the ground electrode is capable of being made greater than the antenna volume of the antenna module 500 according to the comparative example without necessarily increasing the thickness of the dielectric substrate 14 itself. Accordingly, since a frequency bandwidth determined by the antenna volume is capable of being widely ensured and high gain is capable of being ensured in the antenna module 1 according to the present embodiment, compared with those in the antenna module 500 according to the comparative example, antenna characteristics, such as the frequency bandwidth and the gain, are improved.

Furthermore, the ground line 15 is formed along the direction in which the power supply line portion 12*a*1 extends and is overlapped with part of the radiation electrode 11*a* in the above plan view. Accordingly, a so-called strip line structure in which the power supply line portion 12*a*1 is sandwiched between the ground line 15 and the ground electrode 13 is capable of being ensured close to a feeding point of the radiation electrode 11*a*. Consequently, the impedance of the power supply line 12*a* is capable of being set with high accuracy to reduce radio-frequency propagation loss. In addition, since the ground line 15 is arranged between the radiation electrode 11*a* and the power supply line 12*a* due to the strip line structure, it is possible to suppress an occurrence of a defect, such as oscillation of a power amplifier in the RFIC 400, which is caused by unnecessary coupling between the radiation electrode 11*a* and the power supply line 12*a*. As described above, the strip line structure is effective as the structure to improve the effect of shielding the power supply line 12*a*.

Figure 3A:
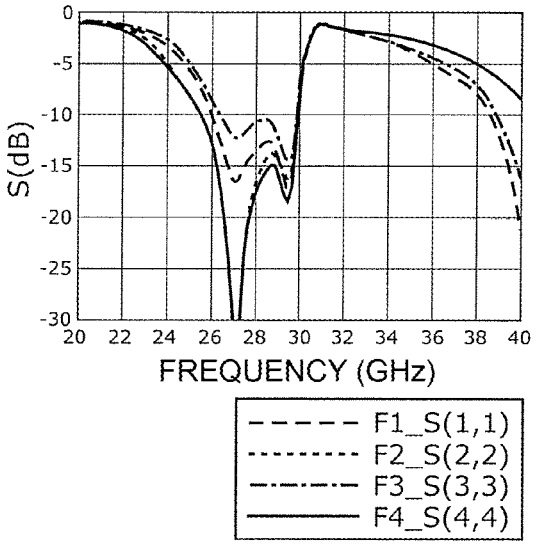
FIG. 3A is a graph representing reflection characteristics of an antenna module according to a first example.
Figure 3B:
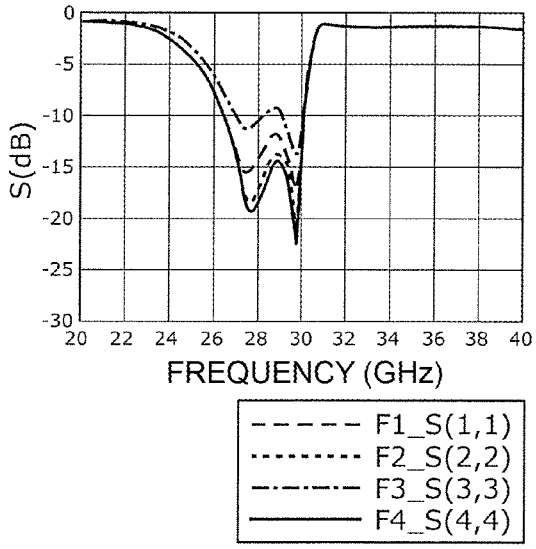
FIG. 3B is a graph representing the reflection characteristics of an antenna module according to a first comparative example.

FIG. 3A is a graph representing reflection characteristics of an antenna module 1A according to a first example. FIG. 3B is a graph representing the reflection characteristics of an antenna module 500A according to a first comparative example. The configurations of the antenna module 1A according to the first example in FIG. 3A and the antenna module 500A according to the first comparative example in FIG. 3B differ from those of the antenna module 1 according to the first embodiment and the antenna module 500 according to the comparative example in that two feeding points are arranged for each radiation electrode and in that the power supply line is connected to each of the two feeding points.

Figure 4:
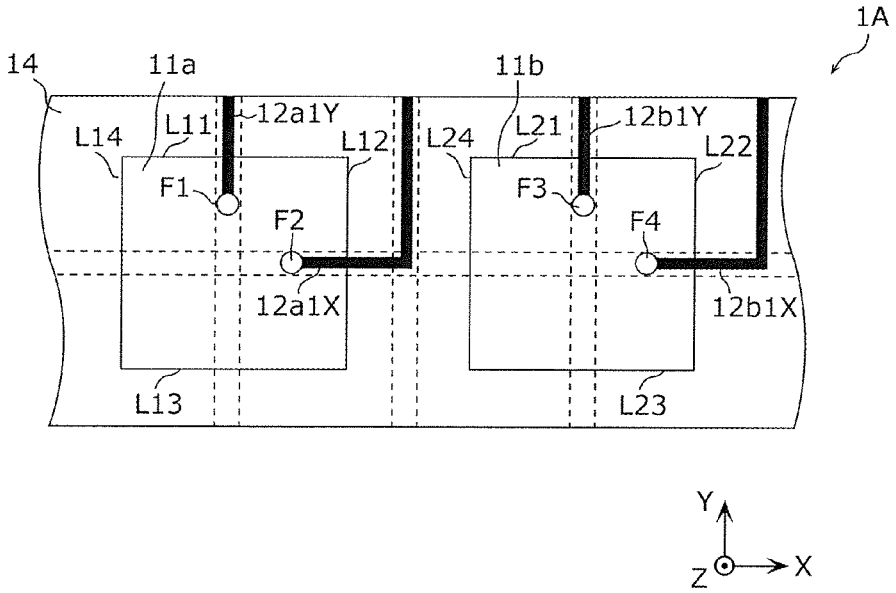
FIG. 4 is a plan view illustrating the structure of power supply lines of the antenna modules according to the first example and the first comparative example.

FIG. 4 is a plan view illustrating the structure of the power supply lines of the antenna module 1A according to the first example and the antenna module 500A according to the first comparative example. As illustrated in FIG. 4, the antenna module 1A according to the first example and the antenna module 500A according to the first comparative example, each includes two feeding points F1 and F2 arranged on the radiation electrode 11*a*, a power supply line portion 12*a*1Y for connecting the feeding point F1 to the RFIC 400, a power supply line portion 12*a*1X for connecting the feeding point F2 to the RFIC 400, a power supply line portion 12*b*1Y for connecting a feeding point F3 to the RFIC 400, and a power supply line portion 12*b*1X for connecting a feeding point F4 to the RFIC 400.

The feeding point F1 is arranged at a position shifted from the center point of the radiation electrode 11*a* in the Y-axis positive direction in a plan view of the dielectric substrate 14. The feeding point F2 is arranged at a position shifted from the center point of the radiation electrode 11*a* in the X-axis positive direction in the above plan view. Accordingly, on the radiation electrode 11*a*, a radiation pattern having two polarization directions: the Y-axis direction and the X-axis direction is created. The feeding point F3 is arranged at a position shifted from the center point of the radiation electrode 11*b* in the Y-axis positive direction in the above plan view. The feeding point F4 is arranged at a position shifted from the center point of the radiation electrode 11*b* in the X-axis positive direction in the above plan view. Accordingly, on the radiation electrode 11*b*, a radiation pattern having two polarization directions: the Y-axis direction and the X-axis direction is created.

In other words, the antenna module 1A according to the first example and the antenna module 500A according to the first comparative example, each composes a dual polarization antenna module having the two polarization directions: the Y-axis direction and the X-axis direction.

The arrangement relationship between the radiation electrode, the ground line, the power supply line, and the ground electrode in a cross-sectional view in the antenna module 1A according to the first example is the same as the arrangement relationship in the antenna module 1 according to the first embodiment. In addition, the arrangement relationship between the radiation electrode, the power supply line, and the ground electrode in a cross-sectional view in the antenna module 500A according to the first comparative example is the same as the arrangement relationship in the antenna module 500 according to the comparative example.

With the above configurations, in the antenna module 1A according to the first example, for example, the bandwidth at which S(1,1) representing the reflection characteristic at the feeding point F1 is −6 dB or less was 4.636 GHz (voltage standing wave ratio (VSWR)<3), as illustrated in FIG. 3A. In addition, S(1,1) to S(4,4) were capable of ensuring −10 dB or less near the center frequency of the band in which S(1,1) to S(4,4) are −6 dB or less.

In contrast, in the antenna module 500A according to the first comparative example, for example, the bandwidth at which S(1,1) representing the reflection characteristic at the feeding point F1 is −6 dB or less was 4.151 GHz (VSWR<3), as illustrated in FIG. 3B. In addition, S(3,3) was −10 dB or more near the center frequency of the band in which S(1,1) to S(4,4) are −6 dB or less.

In other words, with the above configurations, since the antenna volume of the antenna module 1A according to the first example is greater than the antenna volume of the antenna module 500A according to the first comparative example, the wide frequency bandwidth determined by the antenna volume is capable of being ensured and higher gain is capable of being ensured in the antenna module 1A according to the first example, compared with those in the antenna module 500A according to the first comparative example. Accordingly, the antenna characteristics are improved in the antenna module 1A according to the first example.

In the antenna module 1A according to the first example having the above configuration, the radiation electrodes 11*a* and 11*b* have rectangular shapes in the above plan view and the power supply line portion 12*a*1Y intersects with an end side L11 closest to the feeding point F1, among multiple end sides L11, L12, L13, and L14 composing the outer perimeter of the radiation electrode 11*a*. The power supply line portion 12*a*1X intersects with the end side L12 closest to the feeding point F2, among the multiple end sides L11 to L14. The power supply line portion 12*b*1Y intersects with an end side L21 closest to the feeding point F3, among multiple end sides L21, L22, L23, and L24 composing the outer perimeter of the radiation electrode 11*b*. The power supply line portion 12*b*1X intersects with the end side L22 closest to the feeding point F4, among the multiple end sides L21 to L24.

With the above configuration, in the above plan view, the ratio of the area of the power supply line portions 12*a*1Y and 12*a*1X and the ground line 15 overlapped with the power supply line portions 12*a*1Y and 12*a*1X to the area in which the radiation electrode 11*a* is formed is capable of being minimized. In addition, the ratio of the area of the power supply line portions 12*b*1Y and 12*b*1X and the ground line 15 overlapped with the power supply line portions 12*b*1Y and 12*b*1X to the area in which the radiation electrode 11*b* is formed is capable of being minimized. Accordingly, it is possible to maximize the antenna volume without necessarily increasing the thickness of the dielectric substrate 14 itself to further improve the antenna characteristics.

[1.4 Structure of Antenna Module 2 According to Modification]

Figure 5A:
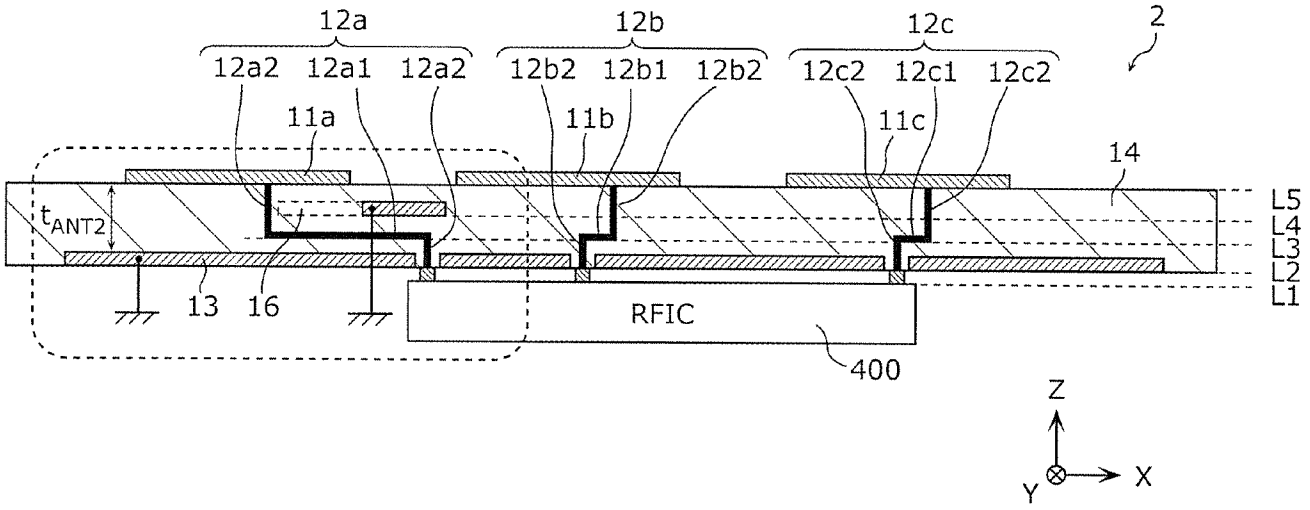
FIG. 5A is a structural cross-sectional view of an antenna module according to a modification of the first embodiment.
Figure 5B:
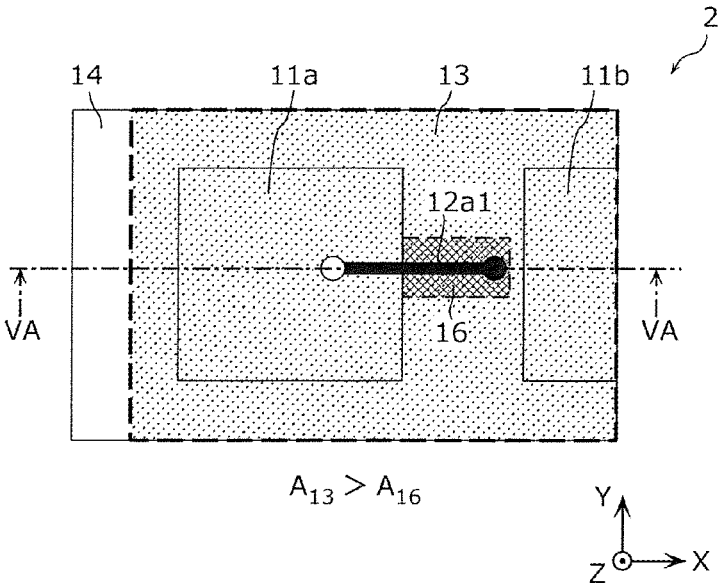
FIG. 5B is a perspective plan view of the antenna module according to the modification of the first embodiment.

FIG. 5A is a structural cross-sectional view of an antenna module 2 according to a modification of the first embodiment. FIG. 5B is a perspective plan view of the antenna module 2 according to the modification of the first embodiment.

As illustrated in FIG. 5A, the antenna module 2 according to the present modification includes the dielectric substrate 14, the radiation electrodes 11*a*, 11*b*, and 11*c*, the RFIC 400, the ground electrode 13, a ground line 16, and the power supply lines 12*a*, 12*b*, and 12*c*. The antenna module 2 illustrated in FIG. 5A and FIG. 5B differs from the antenna module 1 according to the first embodiment only in the arrangement configuration of the ground line 16. As for the antenna module 2 according to the present modification, a description of the points common to the antenna module 1 according to the first embodiment is omitted herein and points different from the antenna module 1 according to the first embodiment will be mainly described.

The ground line 16 is arranged in the dielectric substrate 14 along a direction parallel to the first main surface and the second main surface (along the X-axis direction in FIG. 5A and FIG. 5B).

In addition, the ground line 16 is arranged between the power supply line portion 12*a*1 and the radiation electrodes 11*a*, 11*b*, and 11*c* in the above cross-sectional view, as illustrated in FIG. 5A, and includes part of the power supply line portion 12*a*1 in the above plan view.

Furthermore, although the ground line 16 is formed along the direction in which the power supply line portion 12*a*1 extends in the above plan view, the ground line 16 is not overlapped with the radiation electrode 11*a*.

In the above plan view, a formation area $A_{16}$ of the ground line 16 is smaller than the formation area $A_{13}$ of the ground electrode 13.

With the above configuration, the ground line 16 arranged between the radiation electrode 11*a* and the power supply line portion 12*a*1 is smaller than the ground electrode 13 in the above plan view, as illustrated in FIG. 5B. More specifically, the ground line 16 is not arranged in the area excluding the area overlapped with the power supply line portion 12*a*1 in the above plan view. Accordingly, the effective thickness of the dielectric body between the radiation electrode 11*a* and the ground electrode 13 is not restricted by the arrangement of the power supply line portion 12*a*1. Consequently, the antenna volume defined by the volume of the dielectric body between the radiation electrode and the ground electrode in the antenna module 2 according to the modification is greater than the antenna volume of the antenna module 500A according to the first comparative example. In addition, since the ground line 16 is not overlapped with the radiation electrode 11*a* in the above plan view, the large antenna volume is capable of being ensured, compared with that in the antenna module 1 according to the first embodiment. Accordingly, the antenna characteristics, such as the frequency bandwidth and the gain, are further improved.

However, in the antenna module 2 according to the present modification, the strip line structure is not realized in which the power supply line portion 12*a*1 is sandwiched between the ground line 16 and the ground electrode 13 in the area in which the radiation electrode 11*a* is overlapped with the ground line 16. Accordingly, the antenna module 1 according to the first embodiment is advantageous, compared with the antenna module 2 according to the present modification, in terms of the accuracy of the impedance of the power supply line 12*a*.

Second Embodiment

An antenna module according to the present embodiment is characterized in that the antenna module includes two patch antennas the normal directions of which intersect with each other and in that at least one of the two patch antennas has the configuration of the antenna module according to the first embodiment.

[2.1 Structure of Antenna Module 3 According to Second Embodiment]

Figure 6A:
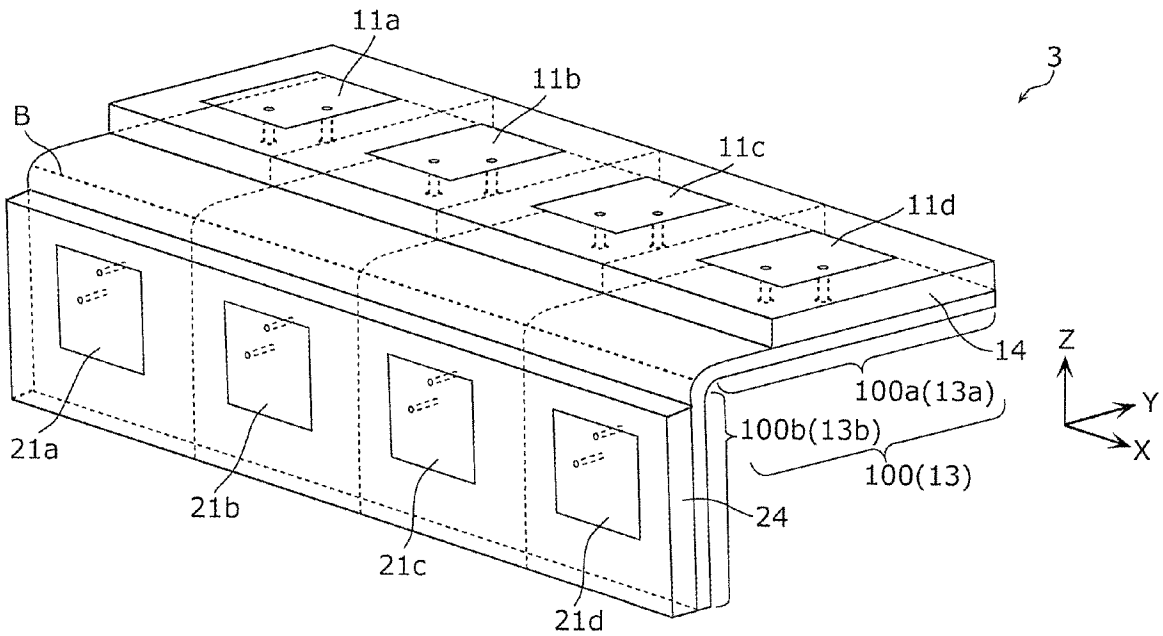
FIG. 6A is an external perspective view of an antenna module according to a second embodiment.
Figure 6B:
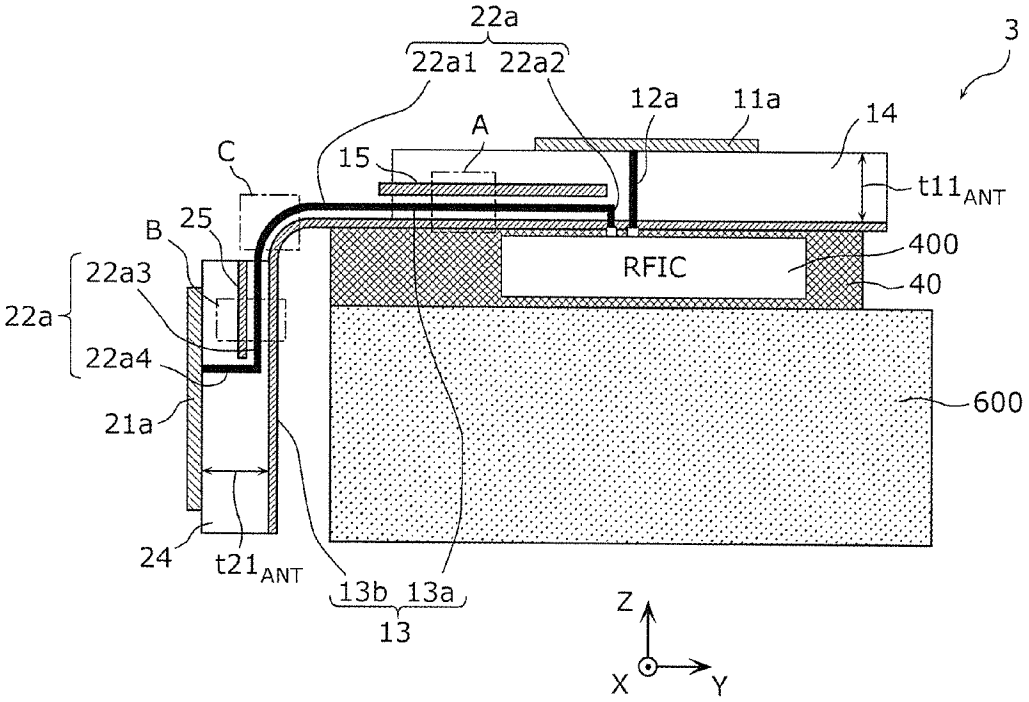
FIG. 6B is a structural cross-sectional view of the antenna module according to the second embodiment.

FIG. 6A is an external perspective view of an antenna module 3 according to a second embodiment. FIG. 6B is a structural cross-sectional view of the antenna module 3 according to the second embodiment. A cross-sectional view in a state in which the antenna module 3 according to the second embodiment is mounted on a mounting board 600 is illustrated in FIG. 6B.

As illustrated in FIG. 6A and FIG. 6B, the antenna module 3 according to the present embodiment includes a substrate 100; the dielectric substrate 14 (a first dielectric substrate) and a dielectric substrate 24 (a second dielectric substrate); the radiation electrode 11*a* (a first radiation electrode), the radiation electrode 11*b* (the first radiation electrode), the radiation electrode 11*c* (the first radiation electrode), and a radiation electrode 11*d* (the first radiation electrode); a radiation electrode 21*a* (a second radiation electrode), a radiation electrode 21*b* (the second radiation electrode), a radiation electrode 21*c* (the second radiation electrode), and a radiation electrode 21*d* (the second radiation electrode); the RFIC 400; a ground electrode 13*a* (a first ground electrode) and a ground electrode 13*b* (a second ground electrode); the ground line 15 (a first ground line) and a ground line 25 (a second ground line); and the power supply line 12*a* (a first power supply line) and a power supply line 22*a* (a second power supply line).

The substrate 100 has a first flat plate portion 100*a* and a second flat plate portion 100*b* the normal directions of which intersect with each other and which are connected with each other. In the present embodiment, the substrate 100 has an L-shaped form in which the substrate 100 is folded along a boundary B at approximately 90 degrees to form the first flat plate portion 100*a* and the second flat plate portion 100*b*.

The dielectric substrate 14 has a first main surface and a second main surface, which are opposed to each other with their back surfaces, and the second main surface of the dielectric substrate 14 is in contact with the front face of the first flat plate portion 100*a*. The dielectric substrate 24 has a third main surface and a fourth main surface, which are opposed to each other with their back surfaces, and the fourth main surface of the dielectric substrate 24 is in contact with the front face of the second flat plate portion 100*b*.

The radiation electrodes 11*a* to 11*d* are formed at the first main surface side of the dielectric substrate 14. The radiation electrodes 21*a* to 21*d* are formed at the third main surface side of the dielectric substrate 24.

The RFIC 400 is formed at the rear face side of the first flat plate portion 100*a*. The RFIC 400 is covered with a resin member 40 filled between the substrate 100 (the ground electrode 13*a*) and the mounting board 600. The RFIC 400 is connected to lines formed in or on the substrate 100 and so on to receive and output power supply voltage, a control signal, and so on through the lines. The RFIC 400 performs at least one of transmission-system signal processing in which a signal supplied from a baseband signal processing circuit (not illustrated) through the lines is subjected to up-conversion and the signal is supplied to the radiation electrodes 11*a* to 11*d* and 21*a* to 21*d* and reception-system signal processing in which radio-frequency signals supplied from the radiation electrodes 11*a* to 11*d* and 21*a* to 21*d* are subjected to down-conversion and the signals are supplied to the baseband signal processing circuit. As the join mode between the RFIC 400 and the mounting board 600, a Cu face formed on the rear face of the RFIC 400 may be joined to the mounting board 600.

The ground electrode 13*a* is arranged on the front face of the first flat plate portion 100*a* or over the first flat plate portion 100*a*. The ground electrode 13*b* is arranged on the front face of the second flat plate portion 100*b* or over the second flat plate portion 100*b*. The ground electrode 13*a* and the ground electrode 13*b* are integrally arranged on the substrate 100 across the first flat plate portion 100*a* and the second flat plate portion 100*b*.

The ground line 15 is arranged in the first dielectric substrate 14 along the direction parallel to the first main surface and the second main surface (along the Y-axis direction). The ground line 25 is arranged in the dielectric substrate 24 along the direction parallel to the third main surface and the fourth main surface (along the X-axis direction).

The power supply line 12*a* electrically connects the radiation electrode 11*a* to the RFIC 400. The power supply line 22*a* electrically connects the radiation electrode 21*a* to the RFIC 400.

The power supply line 22*a* includes a power supply line portion 22*a*1 (the first power supply line portion) arranged in the dielectric substrate 14 along a direction parallel to the Y-axis direction and a power supply line portion 22*a*2 (the second power supply line portion) arranged in the dielectric substrate 14 along the Z-axis direction. The power supply line 22*a* further includes a power supply line portion 22*a*3 (a third power supply line portion) arranged in the dielectric substrate 24 along a direction parallel to the Z-axis direction and a power supply line portion 22*a*4 (a fourth power supply line portion) arranged in the dielectric substrate 24 along the Y-axis direction.

In the above configuration, the radiation electrodes 11*a* to 11*d*, the dielectric substrate 14, the power supply lines 12*a* and 22*a* (the power supply line portions 22*a*1 and 22*a*2), and the ground electrode 13*a* compose a first patch antenna. The radiation electrodes 21*a* to 21*d*, the dielectric substrate 24, the power supply line 22*a* (the power supply line portions 22*a*3 and 22*a*4), and the ground electrode 13*b* compose a second patch antenna.

In the antenna module 3 according to the present embodiment, the first patch antenna has the following characteristic configuration.

The ground electrode 13*a* is arranged between the power supply line portion 22*a*1 and the RFIC 400 in a cross-sectional view of the dielectric substrate 14. The ground line 15 is arranged between the power supply line portion 22*a*1 and the radiation electrode 11*a* in the above cross-sectional view.

The ground electrode 13*a* includes the radiation electrode 11*a* and part of the power supply line portion 22*a*1 in a plan view of the dielectric substrate 14. The ground line 15 includes part of the power supply line portion 22*a*1 in the above plan view.

In the above plan view, the area in which the ground line 15 is formed is smaller than the area in which the ground electrode 13*a* is formed.

In the above configuration, the antenna module 3 includes the first patch antenna and the second patch antenna and the first patch antenna and the second patch antenna have different directivities. Accordingly, the antenna characteristics are improved. In addition, in the first patch antenna, the radiation electrodes 11*a* to 11*d* and the ground electrode 13*a* are capable of being arranged with no restriction of the arrangement of the power supply line portion 22*a*1. Furthermore, the ground line 15 arranged between the radiation electrode 11*a* and the power supply line portion 22*a*1 is smaller than the ground electrode 13*a* in the above plan view. More specifically, the ground line 15 is not arranged in the area excluding the area overlapped with the power supply line portion 22*a*1 in the above plan view. Accordingly, the antenna volume defined by the effective volume of the dielectric body between the radiation electrode 11*a* and the ground electrode 13*a* is capable of being ensured without necessarily increasing the thickness of the dielectric substrate 14. Consequently, the antenna characteristics, such as the frequency bandwidth and the gain, of the first patch antenna, which are determined by the antenna volume, are improved, compared with the antenna module having the configuration in which the ground electrode is arranged between the radiation electrode 11*a* and the power supply line portion 22*a*1.

The ground line 15 is formed along the direction in which the power supply line portion 22*a*1 extends and is overlapped with part of the radiation electrode 11*a* in the above plan view.

With the above configuration, since a so-called strip line structure in which the power supply line portion 22*a*1 is sandwiched between the ground line 15 and the ground electrode 13*a* is capable of being ensured close to the feeding point of the radiation electrode 11*a*, the impedance of the power supply line 22*a* is capable of being set with high accuracy to reduce the radio-frequency propagation loss.

Although the ground line 15 is formed along the direction in which the power supply line portion 22*a*1 extends in the above plan view, the ground line 15 may not be overlapped with the radiation electrode 11*a*.

With the above configuration, since the ground line 15 is not overlapped with the radiation electrode 11*a* in the above plan view, the larger antenna volume is capable of being ensured. Accordingly, the antenna characteristics, such as the frequency bandwidth and the gain, are further improved.

Each of the radiation electrodes 11*a* to 11*d* composing the first patch antenna may include two feeding points. More specifically, the first patch antenna may further include a third power supply line that electrically connects the radiation electrode 11*a* to the RFIC 400 and may form first polarization and second polarization different from the first polarization. In this case, the first polarization and the second polarization have the directivity in a direction perpendicular to the first flat plate portion 100*a*. The radiation electrodes 11*b* to 11*d* may have the same configuration.

With the above configuration, a so-called dual polarization antenna module is capable of being composed in the radiation direction of the first patch antenna.

In addition, in the antenna module according to the present embodiment, the second patch antenna has the following characteristic configuration.

The ground electrode 13*b* is arranged between the power supply line portion 22*a*3 and the rear face of the second flat plate portion 100*b* in a cross-sectional view of the dielectric substrate 24. The ground line 25 is arranged between the power supply line portion 22*a*3 and the radiation electrode 21*a* in the above cross-sectional view.

The ground electrode 13*b* includes the radiation electrode 21*a* and part of the power supply line portion 22*a*3 in a plan view of the dielectric substrate 24. The ground line 25 includes part of the power supply line portion 22*a*3 in the above plan view.

In the above plan view, the area in which the ground line 25 is formed is smaller than the area in which the ground electrode 13*b* is formed.

With the above configuration, in the second patch antenna, the radiation electrodes 21*a* to 21*d* and the ground electrode 13*b* are capable of being arranged with no restriction of the arrangement of the power supply line portion 22*a*3. In addition, the ground line 25 arranged between the radiation electrode 21*a* and the power supply line portion 22*a*3 is smaller than the ground electrode 13*b* in the above plan view. More specifically, the ground line 25 is not arranged in the area excluding the area overlapped with the power supply line portion 22*a*3 in the above plan view. Accordingly, the antenna volume defined by the effective volume of the dielectric body between the radiation electrode 21*a* and the ground electrode 13*b* is capable of being ensured without necessarily increasing the thickness of the dielectric substrate 24. Consequently, the antenna characteristics, such as the frequency bandwidth and the gain, of the second patch antenna, which are determined by the antenna volume, are improved, compared with the antenna module having the configuration in which the ground electrode is arranged between the radiation electrode 21*a* and the power supply line portion 22*a*3.

The ground line 25 is formed along the direction in which the power supply line portion 22*a*3 extends and is overlapped with part of the radiation electrode 21*a* in the above plan view.

With the above configuration, since a so-called strip line structure in which the power supply line portion 22*a*3 is sandwiched between the ground line 25 and the ground electrode 13*b* is capable of being ensured close to the feeding point of the radiation electrode 21*a*, the impedance of the power supply line 22*a* is capable of being set with high accuracy to reduce the radio-frequency propagation loss.

Although the ground line 25 is formed along the direction in which the power supply line portion 22*a*3 extends in the above plan view, the ground line 25 may not be overlapped with the radiation electrode 21*a*.

With the above configuration, since the ground line 25 is not overlapped with the radiation electrode 21*a* in the above plan view, the larger antenna volume is capable of being ensured. Accordingly, the antenna characteristics, such as the frequency bandwidth and the gain, are further improved.

Each of the radiation electrodes 21*a* to 21*d* composing the second patch antenna may include two feeding points. More specifically, the second patch antenna may further include a fourth power supply line that electrically connects the radiation electrode 21*a* to the RFIC 400 and may form third polarization and fourth polarization different from the third polarization. In this case, the third polarization and the fourth polarization have the directivity in a direction perpendicular to the second flat plate portion 100*b*. The radiation electrodes 21*b* to 21*d* may have the same configuration.

With the above configuration, a so-called dual polarization antenna module is capable of being composed in the radiation direction of the second patch antenna.

The mounting board 600 is a board on which the RFIC 400 and the baseband signal processing circuit are mounted and is, for example, a printed circuit board. The mounting board 600 may be the housing of a communication apparatus, such as a mobile phone. As illustrated in FIG. 6B, in the antenna module 3, for example, the main surface of the first flat plate portion 100*a* is arranged so as to be opposed to the main surface of the mounting board 600 and the main surface of the second flat plate portion 100*b* is arranged so as to be opposed to the side face at an end portion of the mounting board 600.

With the above configuration, the antenna module 3 is capable of being arranged at an end portion of the mobile phone or the like. Accordingly, it is possible to decrease the thickness of the communication apparatus, such as the mobile phone, while improving the antenna characteristics, such as the antenna radiation and the reception coverage.

Although both the first patch antenna and the second patch antenna have the configuration of the antenna module 1 according to the first embodiment in the present embodiment, only one of the first patch antenna and the second patch antenna may have the characteristic configuration of the antenna module 1 according to the first embodiment.

[2.2 Line Structure of the Antenna Module 3 According to Second Embodiment]

A characteristic line structure of the antenna module 3 according to the second embodiment will now be described.

Figure 7A:
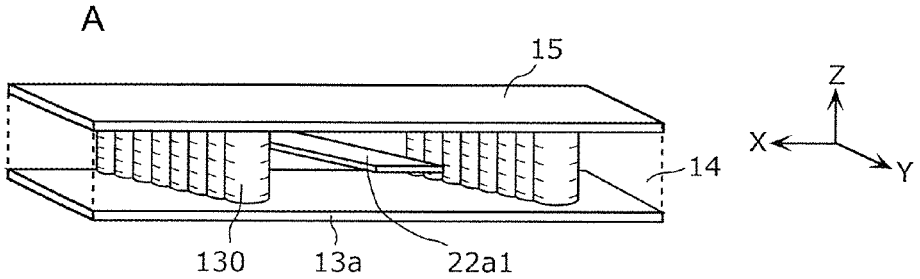
FIG. 7A is a diagram illustrating the structure of the power supply line of a first patch antenna according to the second embodiment.
Figure 7B:
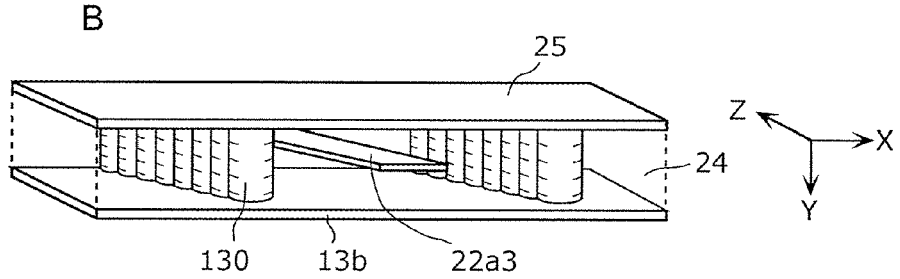
FIG. 7B is a diagram illustrating the structure of the power supply line of a second patch antenna according to the second embodiment.
Figure 7C:
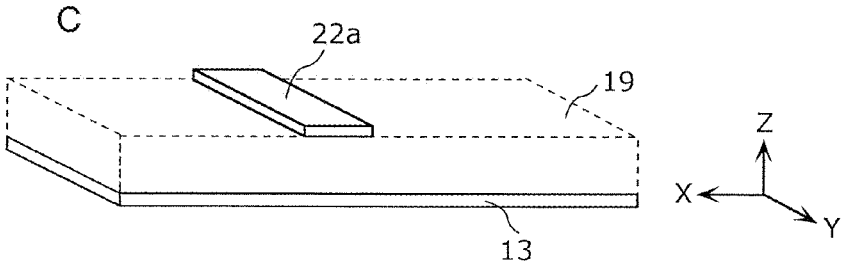
FIG. 7C is a diagram illustrating the structure of the power supply line in a boundary area according to the second embodiment.

FIG. 7A is a diagram illustrating the structure of the power supply line of the first patch antenna according to the second embodiment. FIG. 7B is a diagram illustrating the structure of the power supply line of the second patch antenna according to the second embodiment. FIG. 7C is a diagram illustrating the structure of the power supply line in a boundary area according to the second embodiment.

The structure of the power supply line portion 22*a*1, the ground line 15, and the ground electrode 13*a* in an area A in FIG. 6B is illustrated in FIG. 7A. The power supply line portion 22*a*1 has a strip line structure in which the power supply line portion 22*a*1 is sandwiched between the ground line 15 and the ground electrode 13*a* in the Z-axis direction. The ground line 15 is connected to the ground electrode 13*a* with multiple ground via conductors 130 with which the power supply line portion 22*a*1 is surrounded and which are formed along the power supply line portion 22*a*1. With this configuration, the power supply line portion 22*a*1 is capable of propagating a radio-frequency signal with low loss.

The structure of the power supply line portion 22*a*3, the ground line 25, and the ground electrode 13*b* in an area B in FIG. 6B is illustrated in FIG. 7B. The power supply line portion 22*a*3 has a strip line structure in which the power supply line portion 22*a*3 is sandwiched between the ground line 25 and the ground electrode 13*b* in the Y-axis direction. The ground line 25 is connected to the ground electrode 13*b* with the multiple ground via conductors 130 with which the power supply line portion 22*a*3 is surrounded and which are formed along the power supply line portion 22*a*3. With this configuration, the power supply line portion 22*a*3 is capable of propagating a radio-frequency signal with low loss.

The structure of the power supply line 22*a* and the ground electrode 13 in an area C in FIG. 6B is illustrated in FIG. 7C. The area C is a boundary area between the first patch antenna and the second patch antenna and is a boundary area between the dielectric substrate 14 and the dielectric substrate 24. In this boundary area, the power supply line portion 22*a*1 is continuously connected with the power supply line portion 22*a*3, as illustrated in FIG. 6B. In addition, in this boundary area, the ground electrode 13*a* is integrally and continuously connected with the ground electrode 13*b* and the ground line 15 and the ground line 25 are not formed in the above boundary area. With this arrangement configuration, the power supply line 22*a* has a so-called microstrip line structure in which a dielectric layer 19 is sandwiched between the power supply line 22*a* and the ground electrode 13, as illustrated in FIG. 7C. The advantages when the microstrip line structure is adopted for the power supply line in the boundary area will now be described.

Figure 8:
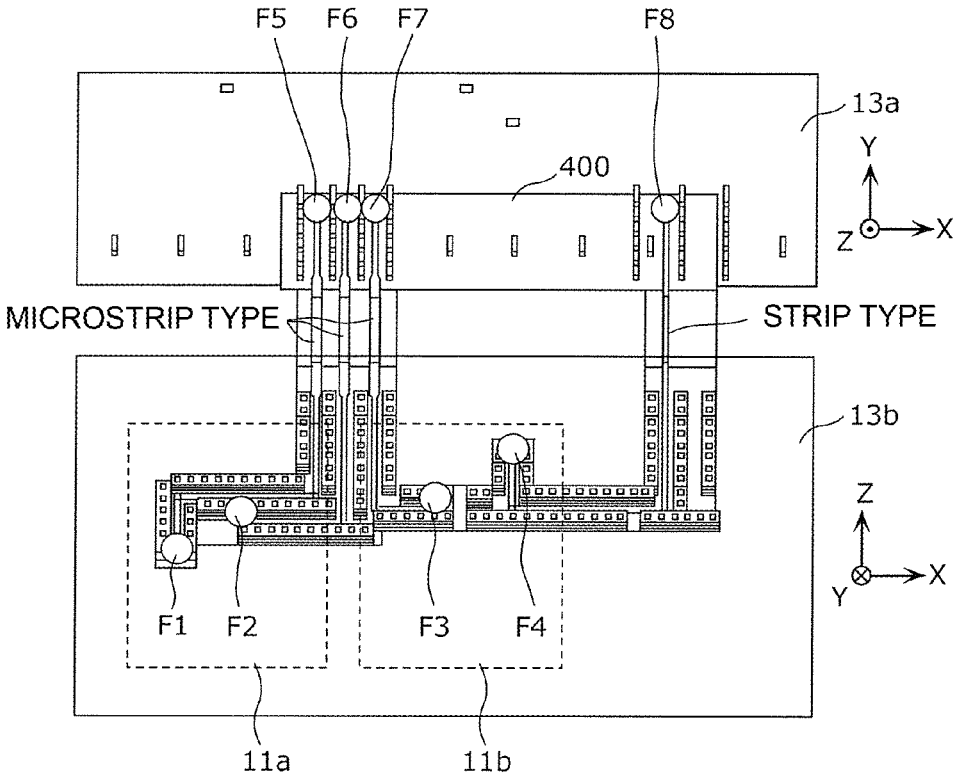
FIG. 8 is a development view of the power supply lines in an antenna module.

FIG. 8 is a development view of the power supply lines in an antenna module. The layout of the power supply lines in the antenna module having the same configuration as that of the antenna module 3 according to the present embodiment is illustrated in FIG. 8. The radiation electrode 11*a* has the two feeding points F1 and F2. The radiation electrode 11*b* has the two feeding points F3 and F4. The feeding point F1 is connected to a terminal F5 of the RFIC 400 via a power supply line of the microstrip type in the boundary area (the strip type in the other area). The feeding point F2 is connected to a terminal F6 of the RFIC 400 via a power supply line of the microstrip type in the boundary area (the strip type in the other area). The feeding point F3 is connected to a terminal F7 of the RFIC 400 via a power supply line of the microstrip type in the boundary area (the strip type in the other area). The feeding point F4 is connected to a terminal F8 of the RFIC 400 via a power supply line of the strip type also in the boundary area (the strip type also in the other area).

In other words, the microstrip structure is used for the F1-F5 power supply line, the F2-F6 power supply line, and the F3-F7 power supply line and the strip structure is used for the F4-F8 power supply line in the boundary area in order to evaluate the relative merits of the structures of the power supply lines in the boundary area. Since the boundary area has a structure in which the boundary area is curved with a certain radius of curvature, as illustrated in FIG. 6A and FIG. 6B, it is not possible to provide the ground via conductors in the strip structure of the F4-F8 power supply line.

Figure 9A:
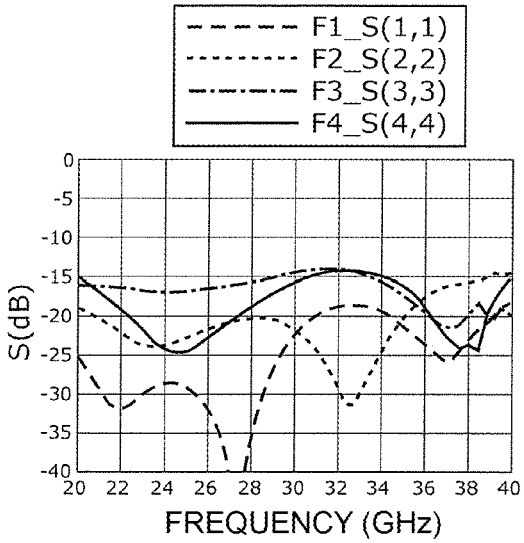
FIG. 9A is a graph representing the reflection characteristics of the power supply lines in an antenna module.
Figure 9B:
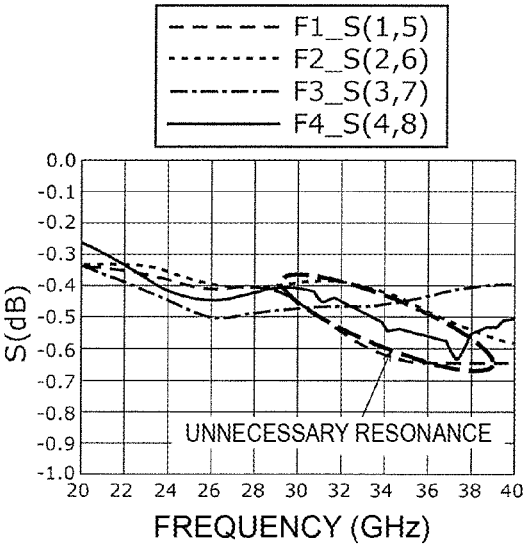
FIG. 9B is a graph representing bandpass characteristics of the power supply lines in the antenna module.

FIG. 9A is a graph representing the reflection characteristics of the power supply lines in an antenna module. FIG. 9B is a graph representing bandpass characteristics of the power supply lines in the antenna module.

Referring to FIG. 9A, at the feeding points F1 to F4, all of S(1,1) to S(4,4) are capable of ensuring −15 dB. In contrast, in the bandpass characteristics in FIG. 9B, unnecessary resonance occurs in S(4,8). This may be because, since the ground via conductors are not provided in the strip structure of the F4-F8 power supply line, a slot antenna is composed due to the coupling between the lines at a side face of the strip structure to cause unnecessary radiation in the X-axis direction.

As described above, in the antenna module 3 according to the present embodiment, the power supply lines in the boundary area between the first patch antenna and the second patch antenna desirably have the microstrip structure. With this structure, since the unnecessary resonance does not occur at the side face of the antenna module 3 in the above boundary area, it is possible to reduce the propagation loss of the power supply lines to improve the antenna characteristics of the second patch antenna.

Although the configuration is adopted in the present embodiment, in which the ground electrode 13*a* and the ground electrode 13*b* are integrally and continuously formed in the boundary area and the ground line is not formed in the boundary area, a configuration may be adopted in which the ground line 15 and the ground line 25 are integrally and continuously formed in the boundary area and the ground electrode is not formed in the boundary area. In other words, the power supply lines in the boundary area may have the microstrip structure in which the dielectric layer 19 is sandwiched between the power supply lines and the ground electrode or the microstrip structure in which the dielectric layer 19 is sandwiched between the power supply lines and the ground line.

Third Embodiment

A communication apparatus including the antenna module according to the first or second embodiment will be described in the present embodiment.

Figure 10:
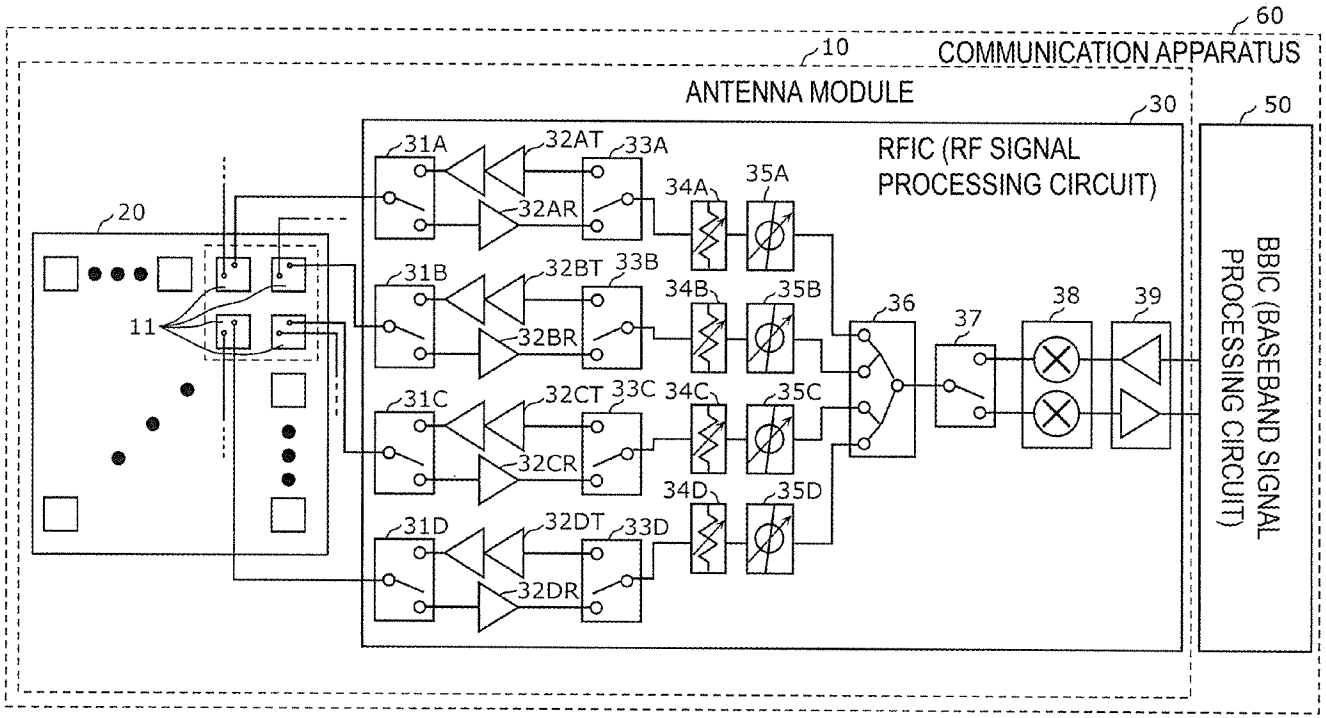
FIG. 10 is a circuit configuration diagram of a communication apparatus according to a third embodiment.

FIG. 10 is a circuit configuration diagram of a communication apparatus 60 according to a third embodiment. As illustrated in FIG. 10, the communication apparatus 60 includes an antenna module 10 and a baseband integrated circuit (BBIC) 50 composing a baseband signal processing circuit. The antenna module 10 includes an array antenna 20 and an RFIC 30. Only the circuit blocks corresponding to four radiation electrodes 11, among the multiple radiation electrodes 11 in the array antenna 20, are illustrated as the circuit blocks in the RFIC 30 in FIG. 10 for simplicity and illustration of the other blocks is omitted herein. In addition, the circuit blocks corresponding to these four radiation electrodes 11 will be described below and a description of the other blocks is omitted herein.

The antenna module 10 is mounted on a mother board, such as a printed circuit board, using its bottom face as the mounting face and, for example, is capable of composing the communication apparatus with the BBIC 50 mounted on the mother board. In this regard, the antenna module 10 according to the present embodiment is capable of controlling the phase and the signal strength of a radio-frequency signal radiated from each radiation electrode 11 to realize sharp directivity. Such an antenna module 10 is capable of being used in, for example, a communication apparatus supporting Massive Multiple Input Multiple Output (MIMO), which is one wireless transmission technology promising in the fifth-generation mobile communication system (5G). Such a communication apparatus will be described below with the processing in the RFIC 30 in the antenna module 10.

Any of the antenna module 1 according to the first embodiment, the antenna module 2 according to the modification of the first embodiment, and the antenna module 3 according to the second embodiment is applied to the array antenna 20. Although each radiation electrode composing the array antenna 20 has two feeding points in FIG. 10, the number of the feeding points is not limited to this. Each radiation electrode composing the array antenna 20 may have one feeding point.

The RFIC 30 includes switches 31A to 31D, 33A to 33D, and 37, power amplifiers 32AT to 32DT, low noise amplifiers 32AR to 32DR, attenuators 34A to 34D, phase shifters 35A to 35D, a signal multiplexer-demultiplexer 36, a mixer 38, and an amplifier circuit 39.

The switches 31A to 31D and 33A to 33D are switch circuits that switch between transmission and reception on the respective signal paths.

A signal transmitted from the BBIC 50 to the RFIC 30 is amplified in the amplifier circuit 39 and is subjected to up-conversion in the mixer 38. The radio-frequency signal subjected to the up-conversion is demultiplexed in the signal multiplexer-demultiplexer 36 and the demultiplexed signals are supplied to different radiation electrodes 11 through four transmission paths. At this time, the levels of phase shift in the phase shifters 35A to 35D arranged on the respective signal paths are individually adjusted to enable adjustment of the directivity of the array antenna 20.

In addition, radio-frequency signals received with the respective radiation electrodes 11 in the array antenna 20 pass through different four reception paths and are multiplexed in the signal multiplexer-demultiplexer 36. The multiplexed signal is subjected to down-conversion in the mixer 38, is amplified in the amplifier circuit 39, and is supplied to the BBIC 50.

Any of the switches 31A to 31D, 33A to 33D, and 37, the power amplifiers 32AT to 32DT, the low noise amplifiers 32AR to 32DR, the attenuators 34A to 34D, the phase shifters 35A to 35D, the signal multiplexer-demultiplexer 36, the mixer 38, and the amplifier circuit 39 described above may not be provided in the RFIC 30. The RFIC 30 may have either of the transmission paths and the reception paths. The communication apparatus 60 according to the present embodiment is applicable to a system that not only transmits and receives radio-frequency signals in a single frequency band but also transmits and receives radio-frequency signals in multiple frequency bands (multiband).

As described above, the RFIC 30 includes the power amplifiers 32AT to 32DT that amplify the radio-frequency signals and the multiple radiation electrodes 11 radiates the signals amplified in the power amplifiers 32AT to 32DT.

Application of any of the antenna module 1 according to the first embodiment, the antenna module 2 according to the modification of the first embodiment, and the antenna module 3 according to the second embodiment to the array antenna 20 in the communication apparatus 60 having the above configuration increases the antenna volume defined by the distance between the radiation electrodes 11 and the ground electrode to provide the communication apparatus having the improved antenna characteristics.

Other Modifications

Although the antenna modules and the communication apparatus according to the embodiments and the examples of the embodiments of the present invention are described above, the present invention is not limited to the above embodiments and the examples of the embodiments. Other embodiments realized by combining arbitrary components in the above embodiments, modifications resulting from making changes supposed by the persons skilled in the art to the above embodiments without necessarily departing from the scope of the present invention, and various devices incorporating the antenna module and the communication apparatus of the present disclosure are also included in the present invention.

For example, although the RFIC 30 is exemplified as the radio-frequency circuit element in the above description, the radio-frequency circuit element is not limited to this. For example, the radio-frequency circuit element may be a power amplifier that amplifies a radio-frequency signal and the multiple radiation electrodes 11 may radiate the signal amplified by the power amplifier. Alternatively, for example, the radio-frequency circuit element may be a phase adjustment circuit that adjusts the phases of radio-frequency signals transmitted between the multiple radiation electrodes 11 and the radio-frequency element.

The configuration including one pattern conductor having the feeding points is exemplified as the radiation electrode in the antenna modules according to the above embodiments and the examples of the embodiments. In contrast, the radiation electrode in the antenna module according to the present invention may include a feed pattern conductor having the feeding points and a non-feed pattern conductor that has no feeding point and that is arranged at the upper face side of the feed pattern conductor so as to be apart from the feed pattern conductor. Even with this configuration, advantages similar to those in the antenna modules according to the above embodiments and the examples of the embodiments are achieved.

For example, the antenna module 3 according to the second embodiment not only has the L-shaped form in which the substrate 100 is folded along the boundary B to form the first flat plate portion 100*a* and the second flat plate portion 100*b* but also may include a third flat plate portion which is connected with the second flat plate portion 100*b* and the normal direction of which intersects with that of the second flat plate portion 100*b*. In this case, the first flat plate portion 100*a* and the third flat plate portion are typically opposed to each other so as to be substantially parallel to each other and a third patch antenna may be arranged in the third flat plate portion. With this configuration, for example, arranging the first flat plate portion 100*a* on the first main surface (the front face) of a mobile phone to be thinned, arranging the third flat plate portion on the second main surface (the rear face) opposed to the first main surface with its back surface, and arranging the second flat plate portion on the side face of an end portion with which the first main surface is connected with the second main surface enable the low profile to be realized.

Although the configuration in which the four radiation electrodes are arranged in the column direction, which is along the boundary B, is exemplified as the configuration of the first patch antenna and the second patch antenna in the second embodiment, it is sufficient for the number of the radiation electrodes arranged on one column to be one or more.

INDUSTRIAL APPLICABILITY

The present invention is widely usable for a millimeter band mobile communication system and a communication device as the antenna module having excellent antenna characteristics, such as the frequency bandwidth and the gain.

REFERENCE SIGNS LIST

1, 1A, 2, 3, 10, 500, 500A antenna module
11, 11*a*, 11*b*, 11*c*, 11*d*, 21*a*, 21*b*, 21*c*, 21*d* radiation electrode
12*a*, 12*b*, 12*c*, 22*a* power supply line
12*a*1, 12*a*1X, 12*a*1Y, 12*a*2, 12*b*1, 12*b*1X, 12*b*1Y, 12*b*2, 12*c*1, 12*c*2, 22*a*1, 22*a*2, 22*a*3, 22*a*4 power supply line portion
13, 13*a*, 13*b*, 513 ground electrode
14, 24 dielectric substrate
15, 16, 25 ground line
19 dielectric layer
20 array antenna
30, 400 RFIC
31A, 31B, 31C, 31D, 33A, 33B, 33C, 33D, 37 switch
32AR, 32BR, 32CR, 32DR low noise amplifier
32AT, 32BT, 32CT, 32DT power amplifier
34A, 34B, 34C, 34D attenuator
35A, 35B, 35C, 35D phase shifter
36 signal multiplexer-demultiplexer
38 mixer
39 amplifier circuit
40 resin member
50 BBIC
100 substrate
100*a* first flat plate portion
100*b* second flat plate portion
130 ground via conductor
600 mounting board
L11, L12, L13, L14, L21, L22, L23, L24 end side

The invention claimed is:

1. An antenna module comprising:
a dielectric substrate having a first main surface and a second main surface, a back surface of the first main surface being opposed to a back surface of the second main surface in the dielectric substrate;
a radiation electrode provided at the first main surface side of the dielectric substrate;
a radio-frequency circuit element provided at the second main surface side of the dielectric substrate;
a ground electrode provided at the second main surface side of the dielectric substrate;
a ground line disposed in the dielectric substrate along a direction parallel to the first main surface and the second main surface; and
a power supply line that electrically connects the radiation electrode to the radio-frequency circuit element,
wherein the power supply line includes
a first power supply line portion arranged in the dielectric substrate along the direction parallel to the first main surface and the second main surface, and
a second power supply line portion arranged in the dielectric substrate along a direction vertical to the first main surface and the second main surface,
wherein the ground electrode is arranged between the first power supply line portion and the radio-frequency circuit element in a cross-sectional view of the dielectric substrate,
wherein the ground line is arranged between the first power supply line portion and the radiation electrode in the cross-sectional view,
wherein the ground electrode includes the radiation electrode and part of the first power supply line portion in a plan view of the dielectric substrate,
wherein the ground line includes part of the first power supply line portion in the plan view, and
wherein an area in which the ground line is provided is smaller than an area in which the ground electrode is provided in the plan view.

2. The antenna module according to claim 1,
wherein the ground line is located along a direction in which the first power supply line portion extends and is overlapped with part of the radiation electrode in the plan view.

3. The antenna module according to claim 2,
wherein the radiation electrode has a rectangular shape in the plan view and has a feeding point that transmits a radio-frequency signal between the radiation electrode and the power supply line, and
wherein, in the plan view, the first power supply line portion intersects with an end side closest to the feeding point, among a plurality of end sides composing an outer perimeter of the radiation electrode.

4. The antenna module according to claim 2,
wherein the radiation electrode includes a plurality of radiation electrodes discretely disposed on the dielectric substrate along the direction parallel to the first main surface and the second main surface, and
wherein the ground electrode includes the plurality of radiation electrodes and part of the first power supply line portion in the plan view of the dielectric substrate.

5. A communication apparatus comprising:
the antenna module according to claim 2; and
a baseband integrated circuit (BBIC).

6. The antenna module according to claim 1, wherein the radiation electrode has a rectangular shape in the plan view and has a feeding point that transmits a radio-frequency signal between the radiation electrode and the power supply line, and wherein, in the plan view, the first power supply line portion intersects with an end side closest to the feeding point, among a plurality of end sides composing an outer perimeter of the radiation electrode.

7. The antenna module according to claim 6, wherein the radiation electrode includes a plurality of radiation electrodes discretely disposed on the dielectric substrate along the direction parallel to the first main surface and the second main surface, and wherein the ground electrode includes the plurality of radiation electrodes and part of the first power supply line portion in the plan view of the dielectric substrate.

8. The antenna module according to claim 1, wherein the radiation electrode includes a plurality of radiation electrodes discretely disposed on the dielectric substrate along the direction parallel to the first main surface and the second main surface, and wherein the ground electrode includes the plurality of radiation electrodes and part of the first power supply line portion in the plan view of the dielectric substrate.

9. A communication apparatus comprising:

the antenna module according to claim 1; and a baseband integrated circuit (BBIC).

10. The communication apparatus according to claim 9, wherein the radio-frequency circuit element is a radio-frequency integrated circuit (RFIC) that is configured to perform:

transmission-system signal processing in which a signal supplied from the BBIC is subjected to up-conversion and the signal is supplied to the radiation electrode;

reception-system signal processing in which a radio-frequency signal supplied from the radiation electrode is subjected to down-conversion and the signal is supplied to the BBIC; or a combination thereof.

11. An antenna module comprising:

a substrate having a first flat plate portion and a second flat plate portion, a normal direction of the first flat plate portion intersecting with a normal direction of the second flat plate portion, the first flat plate portion being connected with the second flat plate portion;

a first dielectric substrate that has a first main surface and a second main surface, a back surface of the first main surface being opposed to a back surface of the second main surface in the first dielectric substrate, the second main surface being in contact with a front face of the first flat plate portion;

a second dielectric substrate that has a third main surface and a fourth main surface a back surface of the third main surface being opposed to a back surface of the fourth main surface in the second dielectric substrate, the fourth main surface being in contact with a front face of the second flat plate portion;

a first radiation electrode provided at the first main surface side of the first dielectric substrate;

a second radiation electrode provided at the third main surface side of the second dielectric substrate;

a radio-frequency circuit element provided at a rear face side of the first flat plate portion;

a first ground electrode provided on the first flat plate portion;

a second ground electrode provided on the second flat plate portion;

a first ground line disposed in the first dielectric substrate along a direction parallel to the first main surface and the second main surface;

a first power supply line that electrically connects the first radiation electrode to the radio-frequency circuit element; and a second power supply line that electrically connects the second radiation electrode to the radio-frequency circuit element, wherein the first power supply line, the second power supply line, or a combination thereof includes:

a first power supply line portion disposed in the first dielectric substrate along the direction parallel to the first main surface and the second main surface, and a second power supply line portion disposed in the first dielectric substrate along a direction vertical to the first main surface and the second main surface, wherein the first ground electrode is disposed between the first power supply line portion and the radio-frequency circuit element in a cross-sectional view of the first dielectric substrate, wherein the first ground line is disposed between the first power supply line portion and the first radiation electrode in the cross-sectional view, wherein the first ground electrode includes the first radiation electrode and part of the first power supply line portion in a plan view of the first dielectric substrate, wherein the first ground line includes part of the first power supply line portion in the plan view, and wherein an area in which the first ground line is provided is smaller than an area in which the first ground electrode is provided in the plan view.

12. The antenna module according to claim 11, wherein the first ground line is located along a direction in which the first power supply line portion extends and is overlapped with part of the first radiation electrode in the plan view of the first dielectric substrate.

13. The antenna module according to claim 12, further comprising:

a third power supply line that electrically connects the first radiation electrode to the radio-frequency circuit element, wherein a first patch antenna composed of the first radiation electrode, the first dielectric substrate, the first power supply line, the third power supply line, and the first ground electrode generates first polarization and second polarization different from the first polarization, and wherein the first polarization and the second polarization have directivity in a direction perpendicular to the first flat plate portion.

14. The antenna module according to claim 11, further comprising:

a third power supply line that electrically connects the first radiation electrode to the radio-frequency circuit element, wherein a first patch antenna composed of the first radiation electrode, the first dielectric substrate, the first power supply line, the third power supply line, and the first ground electrode generates first polarization and second polarization different from the first polarization, and wherein the first polarization and the second polarization have directivity in a direction perpendicular to the first flat plate portion.

15. The antenna module according to claim 11, further comprising:

a second ground line disposed in the second dielectric substrate along a direction parallel to the third main surface and the fourth main surface, wherein the second power supply line includes the first power supply line portion disposed in the first dielectric substrate along the direction parallel to the first main surface and the second main surface, the second power supply line portion disposed in the first dielectric substrate along the direction vertical to the first main surface and the second main surface, a third power supply line portion disposed in the second dielectric substrate along a direction parallel to the third main surface and the fourth main surface, and a fourth power supply line portion disposed in the second dielectric substrate along a direction vertical to the third main surface and the fourth main surface, wherein the second ground electrode is disposed between the second power supply line portion and a rear face of the second flat plate portion in a cross-sectional view of the second dielectric substrate, wherein the second ground line is disposed between the third power supply line portion and the second radiation electrode in the cross-sectional view, wherein the second ground electrode includes the second radiation electrode and part of the third power supply line portion in a plan view of the second dielectric substrate, wherein the second ground line includes part of the third power supply line portion in the plan view, wherein an area in which the second ground line is provided is smaller than an area in which the second ground electrode is provided in the plan view, wherein the first power supply line portion is continuously connected with the third power supply line portion in a boundary area between the first dielectric substrate and the second dielectric substrate, and wherein (1) the first ground electrode and the second ground electrode are integrally disposed on the substrate across the first flat plate portion and the second flat plate portion and the first ground line and the second ground line are not provided in a boundary area between the first flat plate portion and the second flat plate portion or (2) the first ground electrode and the second ground electrode are not provided in the boundary area and the first ground line is integrally connected with the second ground line in the boundary area between the first dielectric substrate and the second dielectric substrate.

16. The antenna module according to claim 15, wherein the second ground line is provided along a direction in which the third power supply line portion extends and is overlapped with part of the second radiation electrode in the plan view of the second dielectric substrate.

17. The antenna module according to claim 16, further comprising:

a fourth power supply line that electrically connects the second radiation electrode to the radio-frequency circuit element, wherein a second patch antenna composed of the second radiation electrode, the second dielectric substrate, the second power supply line, the fourth power supply line, and the second ground electrode forms third polarization and fourth polarization different from the third polarization, and wherein the third polarization and the fourth polarization have directivity in a direction perpendicular to the second flat plate portion.

18. The antenna module according to claim 15, further comprising:

a fourth power supply line that electrically connects the second radiation electrode to the radio-frequency circuit element, wherein a second patch antenna composed of the second radiation electrode, the second dielectric substrate, the second power supply line, the fourth power supply line, and the second ground electrode forms third polarization and fourth polarization different from the third polarization, and wherein the third polarization and the fourth polarization have directivity in a direction perpendicular to the second flat plate portion.

19. A communication apparatus comprising:

The antenna module according to claim 11; and a baseband integrated circuit (BBIC).

20. The communication apparatus according to claim 19, wherein the radio-frequency circuit element is a radio-frequency integrated circuit (RFIC) that is configured to perform:

transmission-system signal processing in which a signal supplied from the BBIC is subjected to up-conversion and the signal is supplied to the first radiation electrode and the second radiation electrode;

reception-system signal processing in which a radio-frequency signal supplied from the radiation electrode is subjected to down-conversion and the signal is supplied to the BBIC; or a combination thereof.

* * * * *